US009120545B2

(12) United States Patent
Kruger

(10) Patent No.: US 9,120,545 B2
(45) Date of Patent: Sep. 1, 2015

(54) APPARATUS FOR DOUSING A SAIL

(71) Applicant: Dirk Rene Kruger, Bridgman, MI (US)

(72) Inventor: Dirk Rene Kruger, Bridgman, MI (US)

( * ) Notice: Subject to any disclaimer, the term of this patent is extended or adjusted under 35 U.S.C. 154(b) by 0 days.

(21) Appl. No.: 14/294,439

(22) Filed: Jun. 3, 2014

(65) Prior Publication Data

US 2014/0352594 A1 Dec. 4, 2014

Related U.S. Application Data

(60) Provisional application No. 61/830,875, filed on Jun. 4, 2013.

(51) Int. Cl.
*B63B 21/08* (2006.01)
*B63H 9/10* (2006.01)

(52) U.S. Cl.
CPC ..... *B63H 9/1021* (2013.01); *B63B 21/08* (2013.01); *B63H 9/1071* (2013.01); *B63H 9/1092* (2013.01)

(58) Field of Classification Search
CPC .. B63H 9/1021; B63H 9/1071; B63H 9/1092; B63B 21/08; F16G 11/10
USPC ..... 114/104, 218
See application file for complete search history.

(56) References Cited

U.S. PATENT DOCUMENTS 3,310,018 A 3/1967 Roberts, Jr. et al.
4,022,144 A 5/1977 Gitchel
4,397,253 A 8/1983 Uecker et al.
4,620,499 A * 11/1986 Slemmons ..... 114/218
4,644,617 A 2/1987 Tupper et al.
4,831,949 A 5/1989 Valiant
5,080,033 A 1/1992 Valiant
5,636,584 A 6/1997 Walker
5,706,750 A 1/1998 Spademan
5,937,779 A 8/1999 Murnikov
6,634,311 B2 10/2003 Cudd, III et al.
6,769,374 B2 8/2004 Cudd, III et al.

FOREIGN PATENT DOCUMENTS

GB 1382694 2/1975
WO WO 95/23732 A1 8/1995

* cited by examiner

*Primary Examiner* — Lars A Olson
(74) *Attorney, Agent, or Firm* — Robert L. Judd

(57) ABSTRACT

An apparatus for dousing a spinnaker sail on a sailboat. The apparatus can include a remote releasable line lock device attached to a lower portion of the spinnaker. A retrieval line for dousing the spinnaker can pass through the remote releasable line lock device and can be attached to an upper portion of the spinnaker. The remote releasable line lock device can include a housing having two cams with at least one cam being movable and biased toward the second cam and positioned to grip the retrieval line. The movable cam can have a cam actuator extending through the sidewall of the housing and can move the movable cam away from the second cam to release the retrieval line. A remote release device can be provided to operate the cam actuator and release the retrieval line when the remote releasable line lock device is positioned in the remote release device.

20 Claims, 15 Drawing Sheets

APPARATUS FOR DOUSING A SAIL

CROSS-REFERENCE TO RELATED APPLICATIONS

This application claims the benefit of U.S. Provisional Application No. 61/830,875 filed on Jun. 4, 2013.

BACKGROUND OF THE INVENTION

1. Field of the Invention

This invention relates to an apparatus for taking in a sail such as but not limited to a spinnaker on a sailboat.

2. Description of Related Art

Arrangements and apparatus for launching and taking sails such as spinnakers on sailboats particularly to facilitate single-handed sailing.

BRIEF SUMMARY OF THE INVENTION

A remote releasable line lock device for remotely releasing a line that can be connected to an object. The remote releasable line lock device can include a housing having a base and a cover, and an attachment point to secure the housing to the object with the line passing longitudinally through the housing through line openings in the housing. The housing can include first and second cams on the base on opposite sides of the line with at least the first cam being movably mounted on the base and biased toward the second cam and having a gripping surface opposite the second cam to grip the line when force is applied to the line in a first direction relative to the housing, and to allow the line to pass through the first cam and the second cam when force is applied to the line in a second opposite direction relative to the housing. The first cam can have a cam actuator extending outwardly from the housing through a cam actuator opening in the housing and can be operable to move the first cam gripping surface away from the second cam to release the line. If desired, a remote release device can be provided having a funnel shaped portion having an open mouth with a diameter larger than the width of the housing with the cam actuator extending outwardly from the housing, a second portion connected to the funnel portion sized to engage and operate the cam actuator when the housing is positioned in the second portion to release the line and thereby allowing line to move independently of the remote releasable line lock device and the object when the housing is positioned in the second portion.

DETAILED DESCRIPTION OF THE INVENTION

Figure 1:
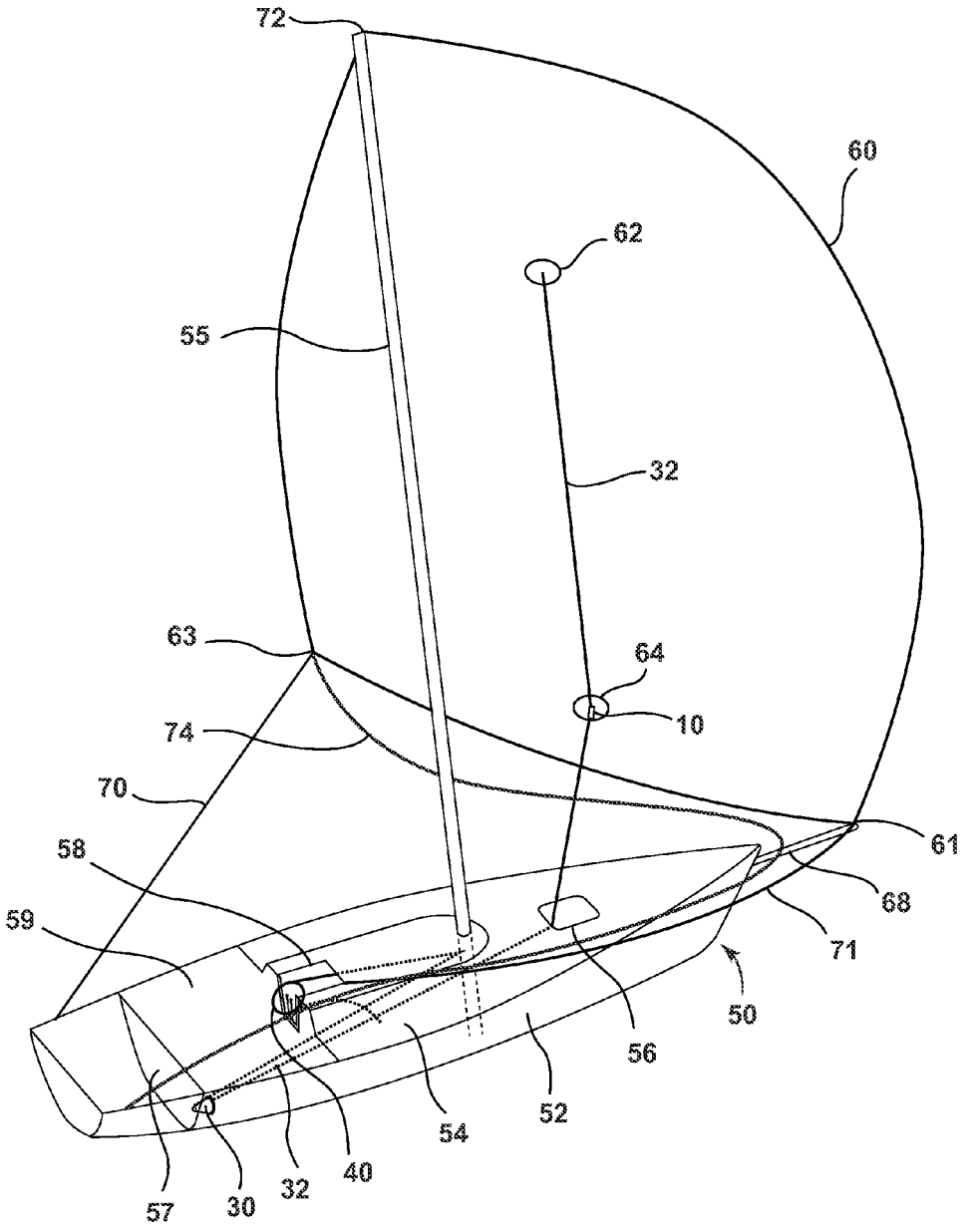
FIG. 1 is a schematic side view of a sailboat with a raised sail having an apparatus for dousing the sail.

FIG. 1 shows a sailboat 50 employing a remote releasable line lock device 10 for use in dousing a sail. Sailboat 50 can have a hull 52 and a deck 54 as are well known in the art. Hull 52 and deck 54 can comprise a mounting for mast 55. A boom, not shown, can be mounted to mast 55 by conventional fittings as are well known. Mast 55 and the boom, not shown, can support a main sail, not shown, as is likewise well known. Mast 55 can be provided with stays, not shown in the drawings, to support mast 55 as is well known in the art.

Figure 4:
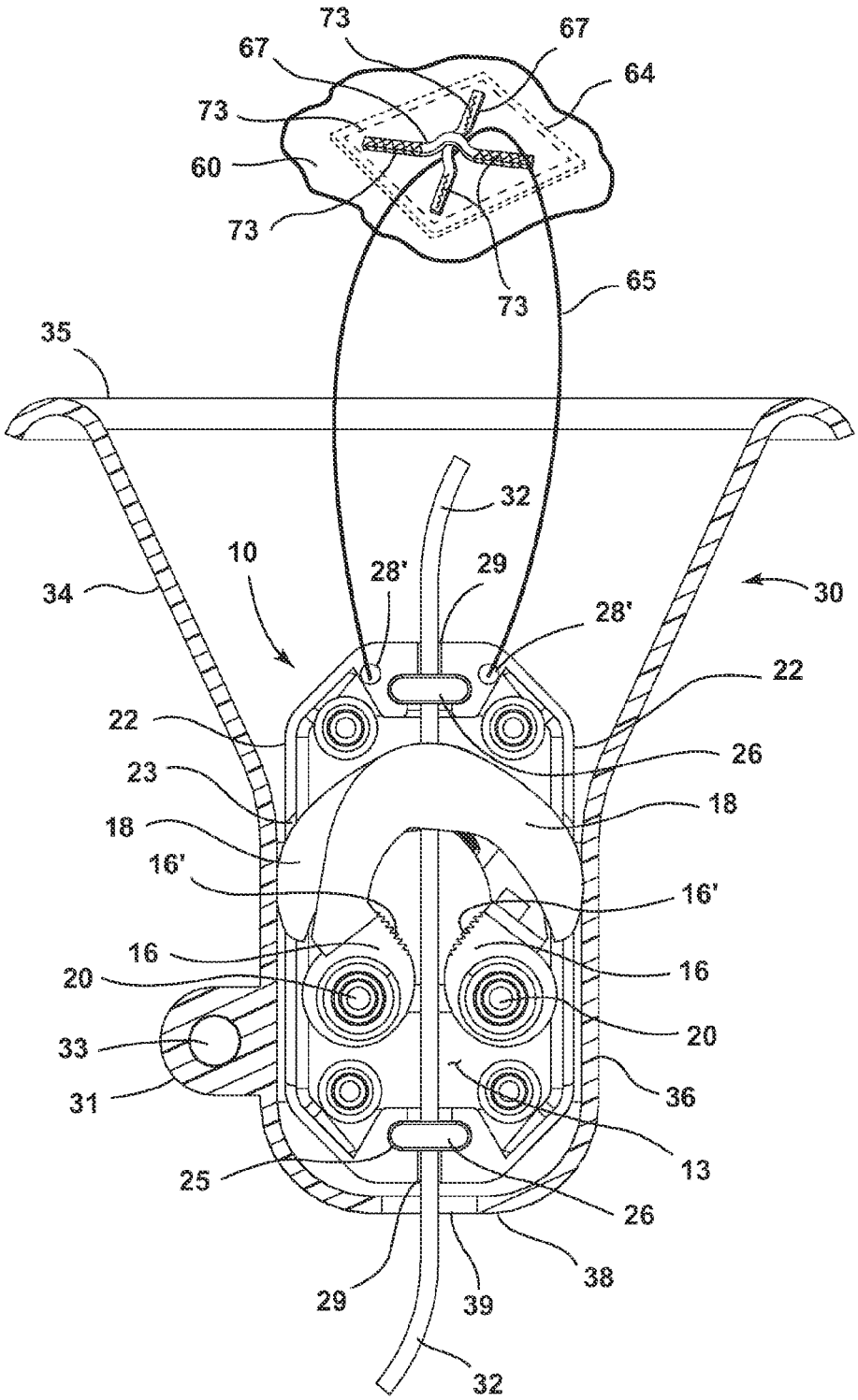
FIG. 4 is an enlarged sectional view showing the remote releasable line lock device of FIG. 3 positioned in the remote release device.

Sail 60 can be a spinnaker sail that can be somewhat triangular in shape and is shown fully raised in FIG. 1. An asymmetrical spinnaker 60 is shown in FIGS. 1, 2 and 16A-D and described in the specification. The remote releasable line lock device will be described in conjunction with an asymmetrical spinnaker 60 but can be used equally as advantageously with a symmetrical spinnaker as will be appreciated by those skilled in the art. Similarly, the remote releasable line lock device 10 can be used with sails other than a spinnaker if desired. Spinnaker sail 60 can have tack 61 attached to a tack line 71 at a bow sprit 68 mounted at the front of hull 52 or deck 54. Clew 63 of sail 60 can be attached to a sheet 70 and a lazy sheet 74 as is well known in the art. The head 72 of spinnaker 60 can be connected to a spinnaker halyard 69 for hoisting the spinnaker 60, see FIGS. 16B-16D. Spinnaker 60 can have a sail patch 62 positioned in the upper portion of spinnaker 60 comprising anchor straps 67 secured to spinnaker 60 and to upper sail patch 62 to provide an attachment point to secure retrieval line 32 to the upper portion of spinnaker 60. As shown in FIG. 4 upper sail patch 62 and anchor straps 67 can be stitched with stitching 73 to spinnaker 60 as is well known in the art. Remote releasable line lock device 10 can be secured to lower sail patch 64 that can comprise anchor straps 67 secured to spinnaker 60 and lower sail patch 64 similar to upper sail patch 62 as shown in FIG. 4. Upper sail patch 62 and lower sail patch 64 can be on the opposite side of spinnaker 60 from anchor straps 67 with the anchor straps 67 sewn through spinnaker 60 to the respective upper sail patch 62 and lower sail patch 64 with stitching 73 as illustrated in FIG. 4. Remote releasable line lock device 10 can be secured to lower sail patch 64 with a line 65 that can pass through anchor straps 67 and be secured to remote releasable line lock 10 at attachment holes 28' as illustrated in FIG. 4 with suitable knots or fasteners. Line 65 can be long enough that the remote releasable line lock device 10 can enter the remote releasable device 30 (see FIG. 4) with the spinnaker 60 remaining out of the funnel portion 34. Those skilled in the art will understand that other means can be used to connect the remote releasable line lock device 10 to spinnaker 60 as desired.

Figure 2:
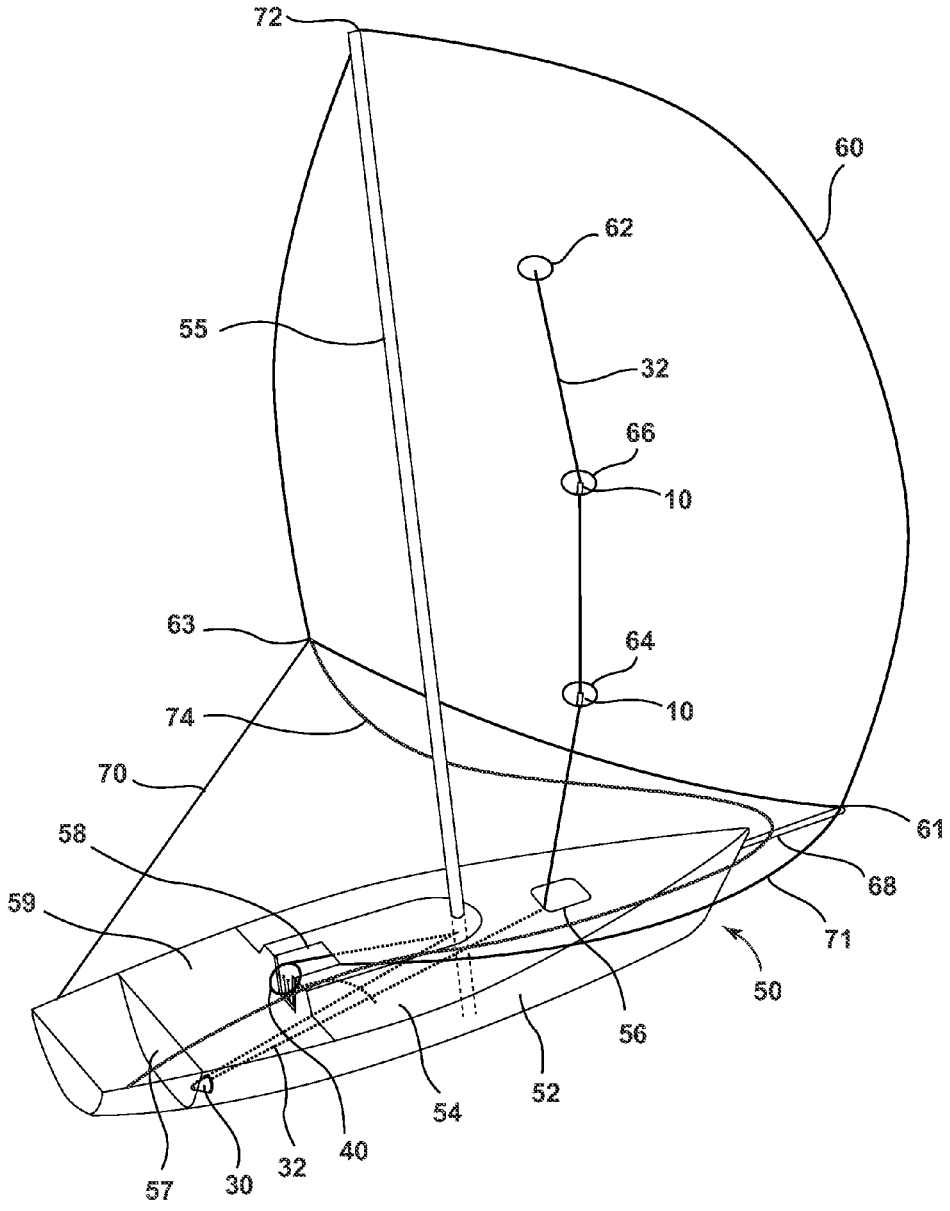
FIG. 2 is a schematic side view of a sailboat with a raised sail having another embodiment of an apparatus for dousing the sail.
Figure 15:
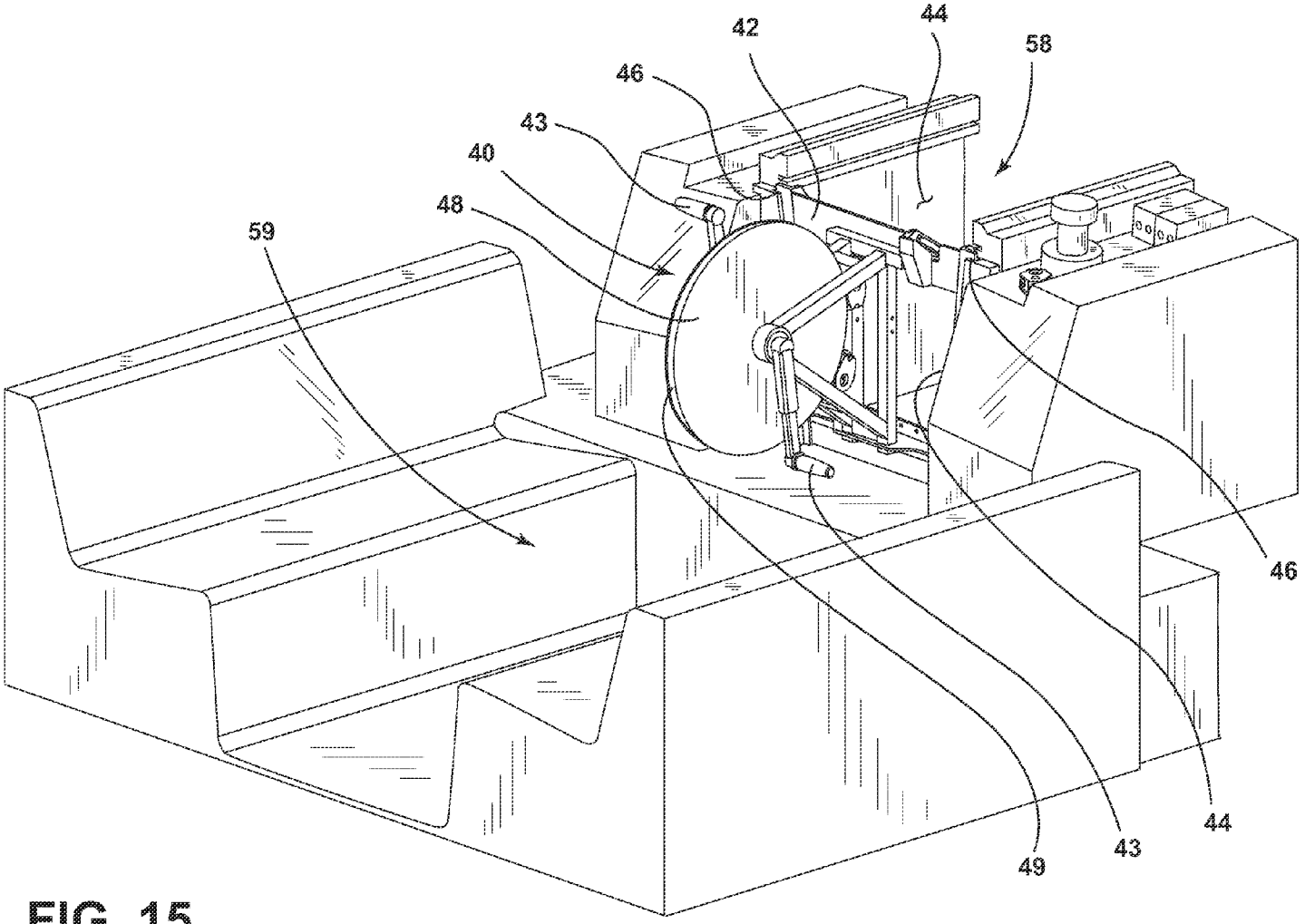
FIG. 15 is a schematic view showing a winch positioned in the companionway of a sailboat that can be used in connection with the apparatus for dousing a sail.

Retrieval line 32 can be attached to upper sail patch 62, fed through a remote releasable line lock device 10 as will be described below and can then be fed through a hatch 56 that can be provided in deck 54 or other spinnaker control surface for guiding spinnaker 60 as the spinnaker 60 is being doused such as a hoop or other surface, not shown. Guiding spinnaker 60 through a hatch 56 can be convenient when it is desired to store the spinnaker 60 below deck 54. While hatch 56 is illustrated as generally square those skilled in the art will understand that hatch 56 can be any desired shape, generally square, generally rectangular, circular, semi-circular, and can have rounded corners and edges to facilitate lines and sails such as a spinnaker 60 being pulled through the hatch 56 without undue restriction or damage to the sail(s). From hatch 56 retrieval line 32 can be fed under deck 54 to the rear of sailboat 50 to a remote release device 30 that can be attached to a bulkhead 57 or other desired surface as shown in FIGS. 1, 2 and 16. Remote release device 30 can be attached to bulkhead 57, or other portion of the hull 52 with a suitable fastener through opening 33 in mounting tab 31. Remote release device 30 will be described in greater detail below. After passing through remote release device 30 retrieval line 32 can pass through pulleys, if desired, so that retrieval line 32 is readily accessible by a crew member. Alternately, if desired, a pulley, not shown, can be provided so that retrieval line 32 can be routed to mast 55, through a pulley, not shown, and to a winch 40 as can be seen in FIG. 15 and described in greater detail below. While sail boat 50 is shown with a deck 54 having a hatch 56, as is well known in the art, some sail boats do not have a deck and/or a hatch arranged for a spinnaker retrieval system.

The remote releasable line lock device 10 can be used with spinnaker retrieval systems that can use a spinnaker control surface comprising a hoop, or other surface, secured to the deck and a cloth sock or plastic tube above or below the deck to contain the spinnaker as it is doused and pulled through the spinnaker control surface. Those skilled in the art will understand that when a spinnaker containment device is used retrieval line 32 can be routed through the containment device, not shown. The remote releasable line lock device 10 can also be used with sail boats without a deck that may only have a spinnaker control surface comprising a hoop or other surface for guiding a spinnaker being doused and may or may not have a sail containment device or system in addition to a spinnaker control surface comprising a hoop or other surface. Further, the remote release device 30 can be located at other locations on sailboat 50 as desired. As noted above, a hatch 56, hoop or other surface, not shown, can be used as a spinnaker control surface. A spinnaker control surface comprising a hoop or other surface, not shown, can be oriented horizontally similar to hatch 56, or can be oriented vertically if desired. Those skilled in the art will understand that spinnaker 60 when doused will be positioned between the spinnaker control surface such as hatch 56 or hoop or other surface, not shown, and remote release device 30. A spinnaker containment device, not shown, can be positioned at any convenient location between the spinnaker control surface that can be a hatch 56, hoop or other surface, not shown, and the remote release device 30. Those skilled in the art will understand that a spinnaker sock or other containment device can be located below or above deck should the sailboat 50 have a deck 54.

Figure 3:
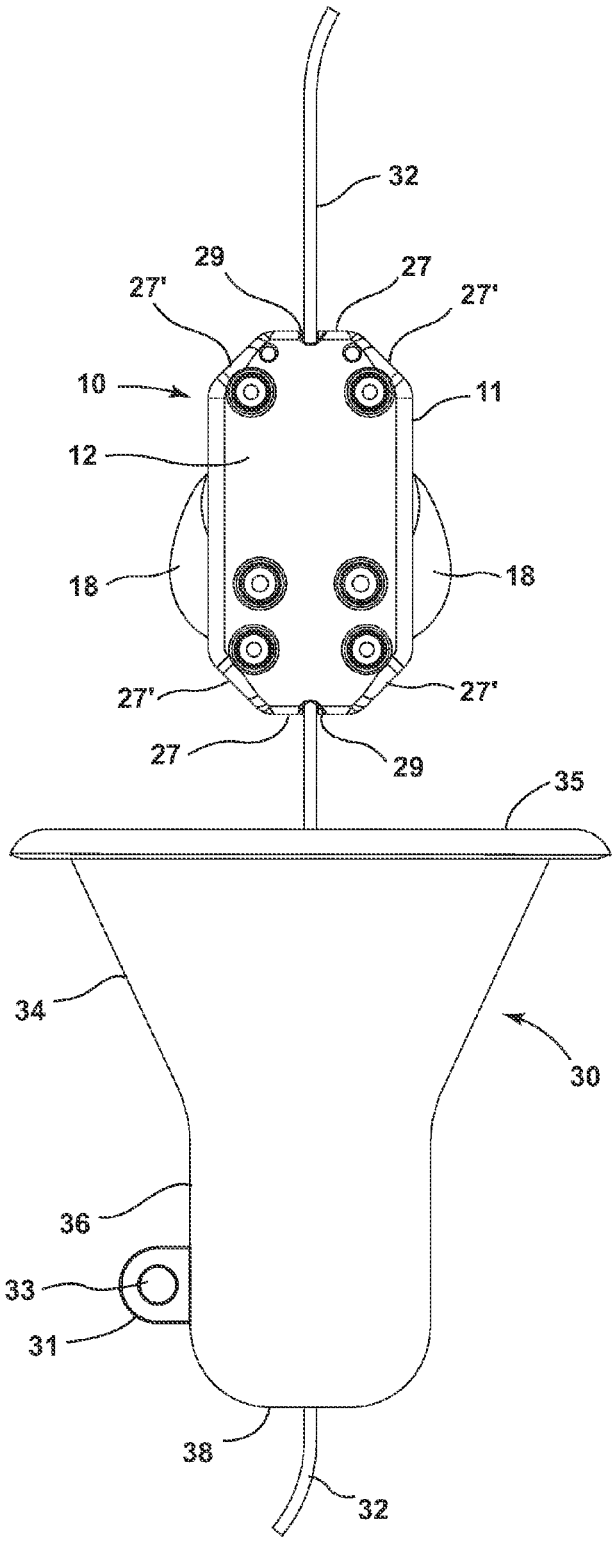
FIG. 3 is an enlarged view of a portion of the apparatus for dousing the sail showing one embodiment of a remote releasable line lock device and a remote release device.
Figure 4A:
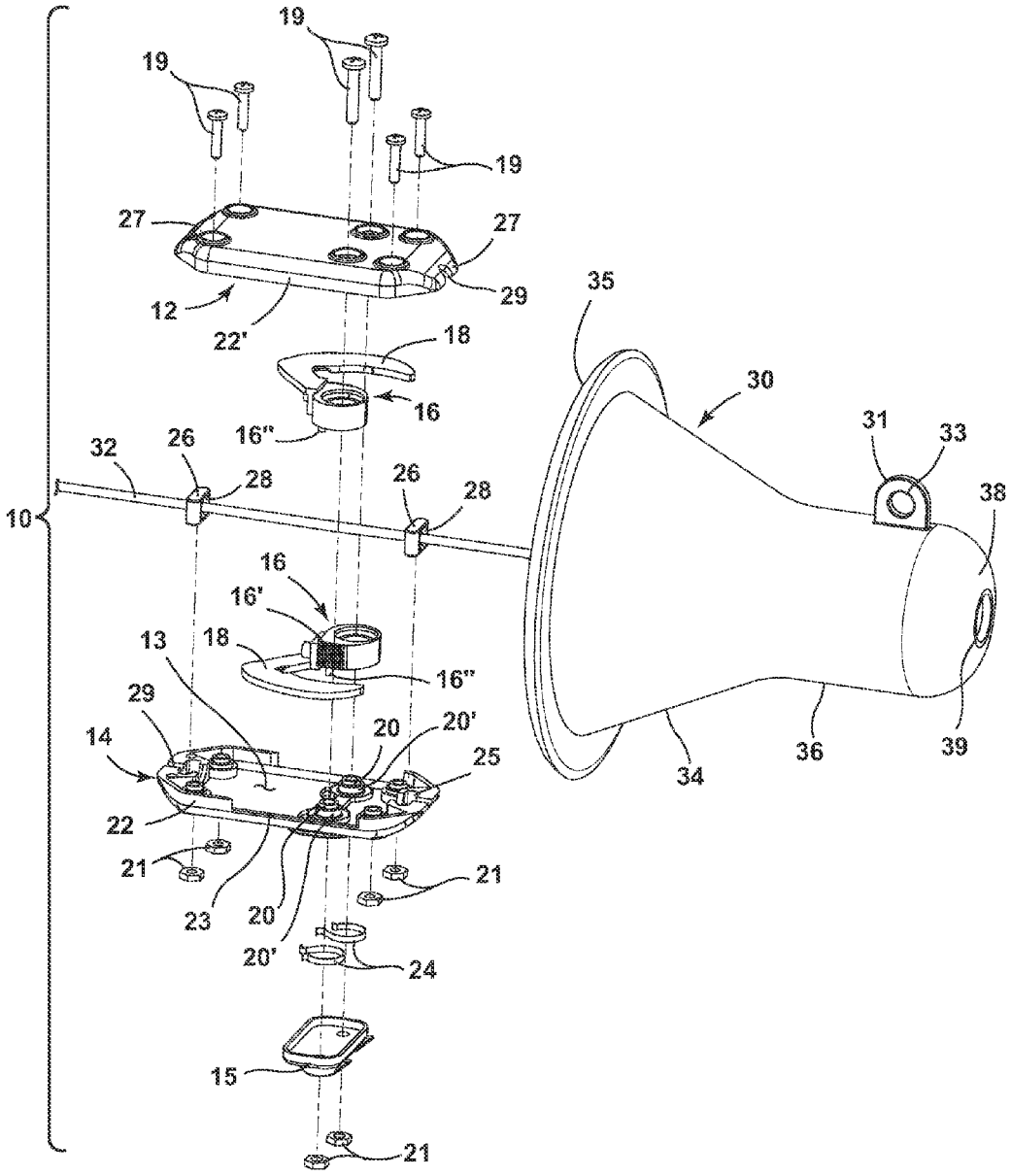
FIG. 4A is an exploded view showing the components of the remote releasable line lock device of FIG. 3.
Figure 4B:
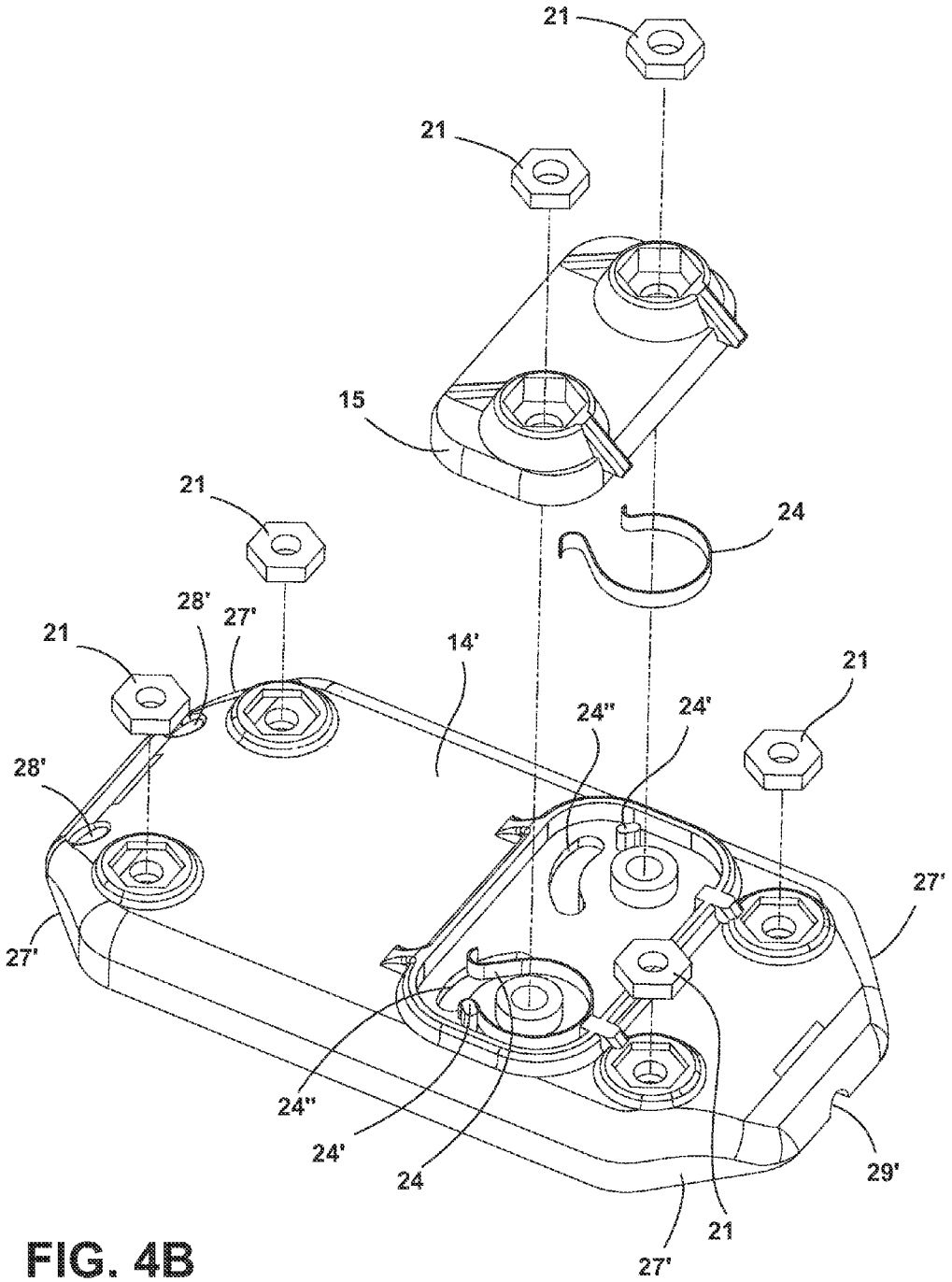
FIG. 4B is a view showing the bottom wall of remote release line lock device of FIG. 3 with the spring cover removed.
Figure 5:
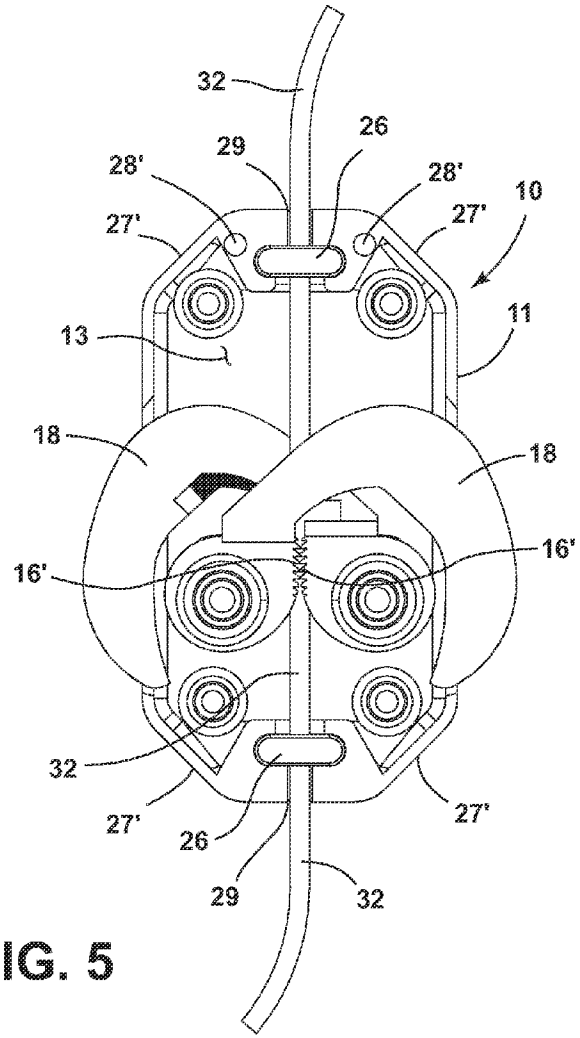
FIG. 5 is a view of the remote releasable line lock device of FIG. 3 with the cover removed showing two cams engaging a line.

Turning to FIGS. 3 to 5, one embodiment of a remote releasable line lock device 10 will be described in greater detail. Remote releasable line lock device 10 can comprise a housing 11 having a base 14 and a cover 12. The remote releasable line lock device housings can be made of plastic or metal material. Base 14 can include cam mounting bosses 20 that can be arranged to pivotally support cams 16 spaced adjacent each other as shown in FIG. 4 A. Cams 16 can each include a cam actuator 18 a portion of which can extend beyond the sidewall 22 of base 14 through an opening or slot 23 formed in side wall 22 as can be seen by referring to FIGS. 3 and 4A. The cams 16 and gripping surfaces 16' can be made of metal or plastic material. Alternately, opening or slot 23 can be in the sidewall 22' of cover 12 or in the sidewalls 22, 22' of both cover 12 and base 14. Suitable bearings 20' can be provided to pivotally support cams 16 on mounting bosses 20 on bearings. Cover 12 and base 14 can have recesses 25 adjacent each end 27 that can be positioned along the centerline of the cover 12 and base 14. Recesses 25 can each position and secure a line guard 26 as shown in FIG. 4. Line guard 26 can have a central opening 28 along the centerline of the remote releasable line lock device 10. Line guards 26 can be formed of heat resistant material. Retrieval line 32 can pass through an opening 29 in each end 27 of the remote releasable line lock device 10 when the cover 12 and base 14 are assembled using bolts 19 and nuts 21 as illustrated in FIG. 4A. Opening 29 in each end 27 can be formed by a recess 29' in each of the cover 12 and the base 14 as shown in FIGS. 4A and 4B. Those skilled in the art will understand alternate fasteners can be used to secure cover 12 and base 14 as desired. After passing through an opening 29 in one end 27 retrieval line 32 can pass through the adjacent line guard 26, through the generally enclosed space 13 formed by the cover 12 and the base 14, between cams 16 when the cam actuators 18 are rotated into housing 11 (see FIG. 4), through the second line guard 26 and out the other end 27 of the remote releasable line lock device 10. Each end 27 of remote releasable line lock device 10 can be tapered at 27' as shown in FIGS. 3, 4 and 5 to minimize the remote releasable line lock device 10 unintentionally snagging on items on the sail boat 50 and to facilitate remote releasable line lock device 10 entering remote release device 30 as spinnaker is doused as will be described in greater detail below.

Each cam 16 can have a post 16" that can extend through an arcuate slot 24" in the bottom wall of base 14 adjacent cam mounting boss 20. On the bottom side 14' of base 14 a fixed spring post 24' can be provided opposite arcuate slot 24". One end of spring 24 (see FIG. 4 B) can engage fixed spring post 24' with the other end of spring 24 engaging cam post 16" extending through arcuate slot 24" when cam 16 is installed so that spring 24 can bias cam actuators 18 outwardly to the extended position and the cam gripping surfaces 16' into engagement with release line 32 as shown in FIG. 5. While the remote releasable line lock device 10 illustrated in FIGS. 1-5 comprises an arcuate spring 24, those skilled in the art will understand that any resilient biasing arrangement can be used to bias cam gripping surfaces 16' into engagement with release line 32 and cam actuators 18 outwardly as shown in FIG. 5.

Referring to FIGS. 3 to 5, when remote releasable line lock device 10 is not positioned in a remote release device 30, cam actuators 18 can extend outwardly through openings or slots 23 in housing 11. With cam actuators 18 extending outwardly as in FIGS. 3 and 5, cams 16 rotate into engagement with retrieval line 32 with cam gripping surfaces 16' securely gripping retrieval line 32 as shown in FIG. 5. The cam actuators 18 can be made of metal or plastic material. When force is applied to retrieval line 32 in the downward direction in FIG. 5 remote releasable line lock device 10 is secured to retrieval line 32 so that remote releasable line lock device 10 moves with retrieval line 32. However, when force is applied in the upward direction in FIG. 5, the force applied to retrieval line 32 can cause cams 16 to rotate toward the position shown in FIG. 4 releasing retrieval line 32 and allowing retrieval line 32 to pass in the upward direction as shown in FIG. 5 through remote releasable line lock device 10. When force is applied to retrieval line 32 in the downward direction in FIG. 3, retrieval line 32 can pass through to the opening 39 in end wall 38 of remote release device 30 and remote releasable line lock device 10 can move toward and into the mouth 35 of funnel portion 34 of remote release device 30. As remote releasable line lock device 10 continues into remote release device 30 (i.e. from the position in FIG. 3 to the position in FIG. 4), remote release line lock 10 can initially easily enter remote release device 10 as the mouth 35 of funnel portion 34 is larger than the remote releasable line lock device 10. As retrieval line 32 continues to move remote releasable line lock device 10 from the funnel portion 34 into the cylindrical portion 36, the cylindrical portion 36 can rotate cam actuators 18 into the housing 11 rotating cams 16 and cam gripping surfaces 16' out of engagement with retrieval line 32. With remote releasable line lock device 10 in the position shown in FIG. 4, retrieval line 32 is free to move downwardly through remote releasable line lock device 10. While the embodiment of remote releasable line lock device 10 illustrated in FIGS. 1-5 includes cam actuators 18 arranged to rotate cams 16 when a remote releasable line lock device 10 enters a remote release device 30, those skilled in the art will understand that any mechanism or arrangement to cause cams 16 to rotate to release line 32 can be employed as desired.

Figure 16B:
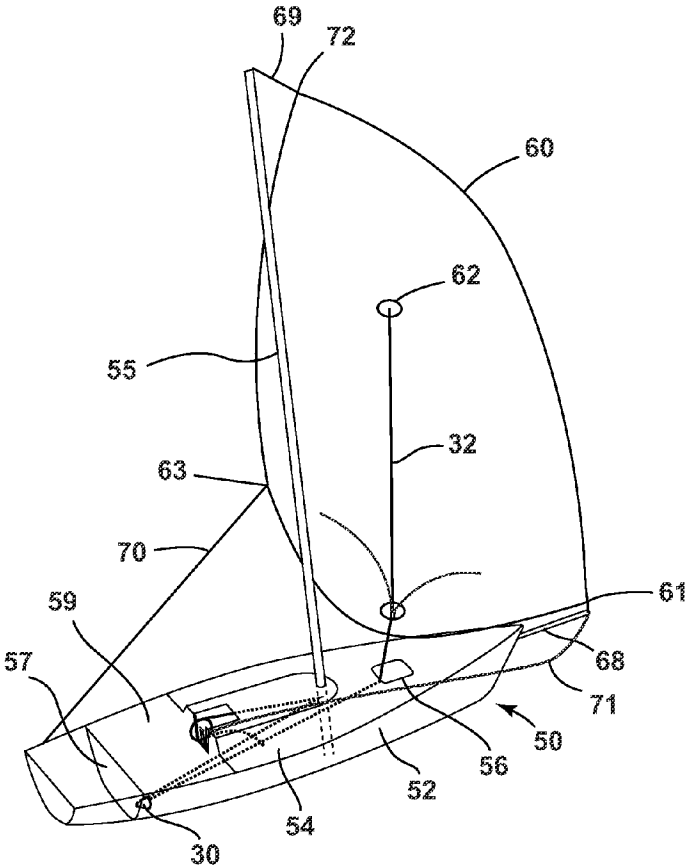
FIG. 16B is a schematic view of the sailboat of FIG. 16A illustrating the remote releasable line lock device at the beginning of dousing the sail.
Figure 16A:
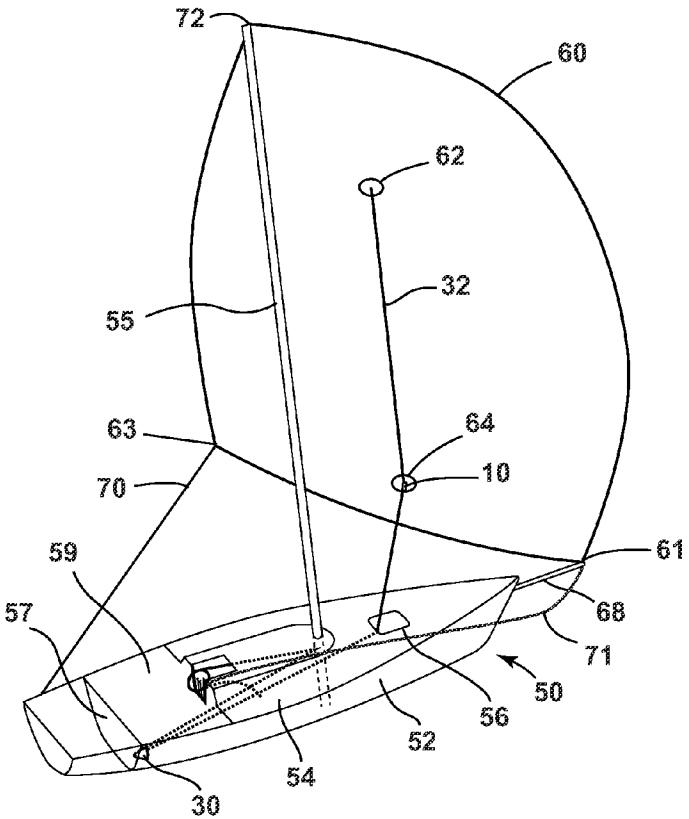
FIG. 16A is a schematic view of a sailboat with a remote releasable line lock device attached to a sail with the sail completely hoisted.
Figure 16D:
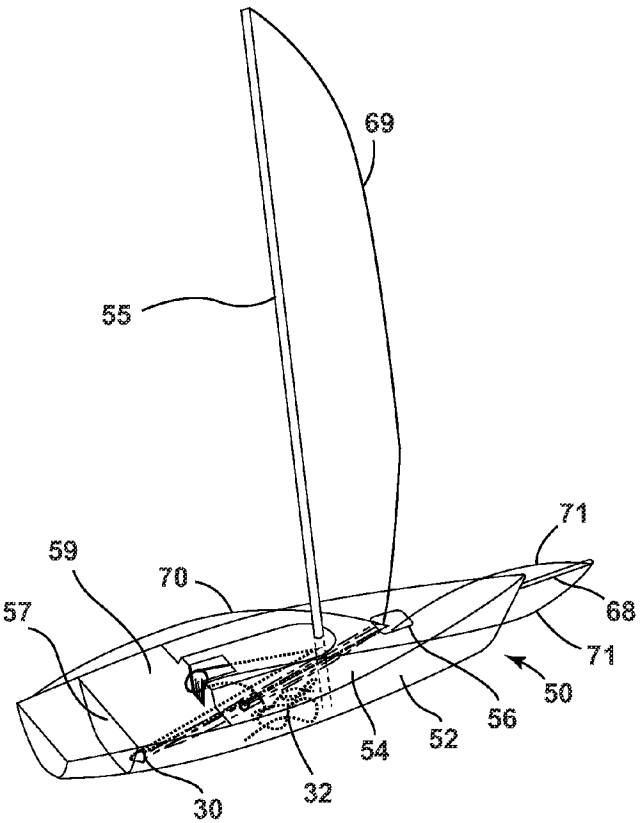
FIG. 16D is a schematic view of the sailboat of FIG. 16 A illustrating the sail completely doused.
Figure 16C:
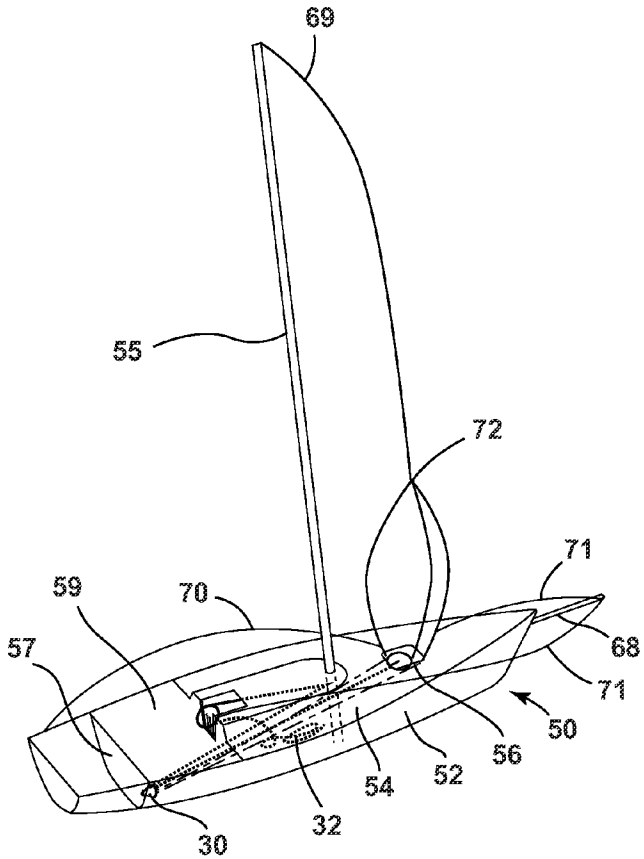
FIG. 16C is a schematic view of the sailboat of FIG. 16 A illustrating the remote releasable line lock device engaging the remote release device during sail dousing.

Referring to FIGS. 1 and 16A-D, as retrieval line 32 is pulled force is applied to the remote releasable line lock device 10 that can be attached to spinnaker 60 as described above. Lazy sheet 74 illustrated in FIGS. 1 and 2 is omitted in FIGS. 16A-D to simplify FIGS. 16A-D. Force applied to retrieval line 32 can douse the spinnaker 60 as follows. Retrieval line 32 can be manually pulled to douse the spinnaker 60 or can be winched using winch 40 as will be described below. Starting in the configuration shown in FIG. 16A, when spinnaker halyard line 69, sheet 70 and tack line 71 are released, pulling on retrieval line 32 can draw the spinnaker 60 downward and toward a spinnaker control surface, hatch 56 in this embodiment, from the lower portion of the spinnaker 60 as illustrated in FIG. 16B. With a controlled release of spinnaker halyard 69 and pulling on the lower portion of spinnaker 60, prevention of spinnaker 60 spilling into the water and/or getting tangled in the rigging can be achieved. Those skilled in the art will be familiar with common methods to controllably release a halyard which can include an additional crew member. Continued pulling on retrieval line 32 can continue to draw spinnaker 60 downward and into hatch 56 until remote releasable line lock device 10 reaches remote release 30 as shown in FIG. 16C. As remote releasable line lock device 10 moves from the funnel portion 34 into the cylindrical portion 36 of remote release 30 cam actuators 18 engage the cylindrical portion 36 depressing cam actuators 18 rotating cams 16 and cam gripping surfaces 16' out of engagement with retrieval line 32 as described above. With cams 16 and cam gripping surfaces 16' no longer engaging retrieval line 32, continued pulling on retrieval line 32 can apply force to upper sail patch 62 drawing the remaining portion of spinnaker 60 into hatch 54 as illustrated in FIG. 16D with spinnaker halyard 69, sheet 70 and tack line 71 trailing.

A significant advantage of the apparatus for dousing a sail is that a solo sailor can easily douse a spinnaker 60 sail from the cockpit 59 of the sailboat 50 single handed since remote release device 30 can cause remote releasable line lock device 10 to disengage retrieval line 32 without any action by a crew member other than continued pulling on (or winching) retrieval line 32. Also, the spinnaker 60 does not need to be repacked to deploy the spinnaker 60 again. On a crewed boat utilizing the remote releasable line lock device 10 and arrangement for dousing the spinnaker, the crew is not burdened with spinnaker issues after the sail is doused allowing the crew to immediately perform other functions. By applying force initially to the lower portion of the spinnaker 60 at lower sail patch 64 spinnaker 60 can be controlled and doused without risking the spinnaker dropping into the water and or getting tangled with the sailboat. Continued pulling (or winching) retrieval line 32 can first pull the lower portion of spinnaker 60 down and through a spinnaker control surface such as hatch 56, and then without any need to stop and change lines, a solo sailor can continue pulling the upper portion of spinnaker 60 through the spinnaker control surface such as hatch 56 when remote releasable line lock device 10 enters into remote release device 30 opening cams 16 and cam gripping surfaces 16' without any action on the part of the sailor. Thus assuring that spinnaker 60 can be doused without a risk that spinnaker 60 will fall into the water or become tangled with rigging. On sailboats with multiple crew members, crew members can be positioned at the front of the sailboat to attempt to gather the spinnaker sail as it is lowered to prevent the spinnaker from entering the water which can not only slow the boat but create a hazard for the crew. For a solo sailor control of the spinnaker as it is doused can be a significant problem without use of the apparatus for dousing a sail. Sailboat 50 can be outfitted with a dousing sock or spinnaker sleeve above or below deck 54, not shown, as noted above. When a spinnaker sleeve, not shown, or other storage space or apparatus for storing the spinnaker is employed, retrieval line 32 can pass through the spinnaker sleeve, not shown, or other storage space between hatch 56 and remote release device 30. When a spinnaker sleeve, not shown, is employed spinnaker 60 can be contained in the spinnaker sleeve, not shown, at the end of the dousing procedure as illustrated in FIG. 16D.

Figure 6:
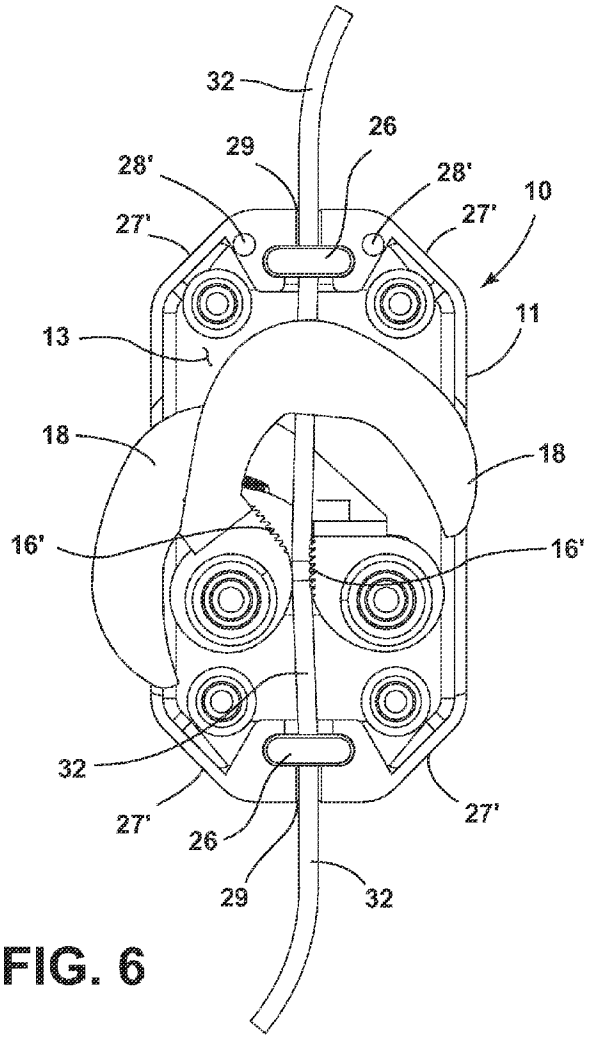
FIG. 6 is a view of the remote releasable line lock device of FIG. 3 with the cover removed showing one cam engaging a line.

Referring to FIG. 6 an advantage of employing two cams 16 and cam gripping surfaces 16' in a remote releasable line lock device 10 can be seen. FIG. 6 illustrates a situation in which one of the cam actuators 18 is depressed into housing 11 such as can occur when remote releasable line lock device 10 strikes a portion of sail boat 50 as spinnaker 60 is being doused. With one cam actuator 18 depressed (the right hand cam actuator 18 in FIG. 6) retrieval line 32 is still locked so that spinnaker 60 will not be released during dousing of the spinnaker 60 as described above.

Hoisting the spinnaker 60 can be accomplished by pulling (or winching) spinnaker halyard 69 connected at the top of the spinnaker 60. Spinnaker halyard 69 and retrieval line 32 can be a single line or joined lines if desired. As spinnaker halyard 69 is pulled (or winched) spinnaker 60 can be drawn out of its storage location, such as a spinnaker sleeve, not shown, above or below deck 54, beginning at the position shown in FIG. 16D and progressively moving to the position shown in FIG. 16A. Once spinnaker 60 is in the fully raised position sheet 70 and tack line 71 can be adjusted to position the spinnaker 60 as desired. The combined weight of the spinnaker 60 and remote releasable line lock 10 can cause the remote releasable line lock device 10 and spinnaker 60 to slide down retrieval line 32 since the remote releasable line lock device 10 is not arranged to grip retrieval line 32 when upward force is applied. Upward force is applied to retrieval line 32 as it is pulled upwardly as spinnaker 60 is hoisted by spinnaker halyard 69. Retrieval line 32 can continue to slide upwardly through remote releasable line lock device 10 until spinnaker 60 is filled between upper sail patch 62 and lower sail patch 64. With spinnaker 60 filled between upper and lower sail patches 62 and 64 remote releasable line lock device 10 can once again grip retrieval line 32 thus resetting the remote releasable line lock device 10 for dousing the spinnaker 60.

Figure 13:
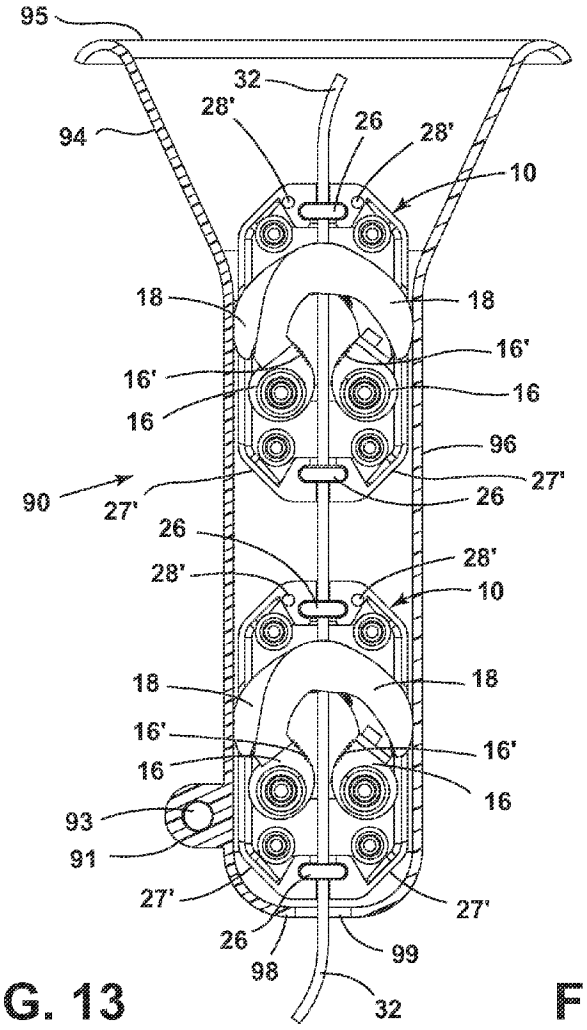
FIG. 13 is a sectional view showing two remote releasable line lock devices of FIG. 3 positioned in a remote release device.

If desired multiple remote releasable line locks 10 can be used in combination with a sail. Turning to FIGS. 2 and 13, a spinnaker sail 60 can be seen employing two remote releasable line locks 10. Common elements of the sail boat 50 and the apparatus for dousing a sail are referred to with the same numerals in FIGS. 2 and 13. In the FIG. 2 embodiment retrieval line 32 can be attached to upper sail patch 62 similar to the embodiment illustrated in FIG. 1, and retrieval line 32 can pass through first and second remote releasable line locks 10 connected respectively to mid sail patch 66 and lower sail patch 64 as described above. In each case releasable line locks 10 can function in the same manner as in the embodiment of FIG. 1. Remote release device 90 can have a mounting tab 91 with an opening 93 for mounting the remote release device. Remote release device 90 can have a mouth 95, a funnel portion 94 and a cylindrical portion 96 and an end wall 98 with an opening 99 for a release line 32. Remote release device 90 can be similar to remote release device 30 with the exception of cylindrical portion 96 being elongated to accommodate two remote releasable line lock devices 10 as illustrated in FIG. 13. While FIGS. 2 and 13 illustrate use of two remote releasable line lock devices 10, more than two remote releasable line lock devices 10 can be provided for a sail if desired by extending the cylindrical portion of the remote release device to accommodate the number of remote releasable line lock devices 10 to be employed. As line 32 is pulled to douse the spinnaker 60 in FIG. 2, and the remote releasable line lock device 10 connected to lower sail patch 64 reaches remote release device 90 cam actuators 18 engage cylindrical portion 96 rotating cams 16 and cam gripping surfaces 16' out of contact with retrieval line 32 allowing retrieval line 32 to pull on mid sail patch 66 to continue pulling spinnaker 60 through a spinnaker control surface such as hatch 56 or a hoop or other surface, not shown. Similarly, when the second remote releasable line lock device 10 enters cylindrical portion 96 of remote release device 90 cam actuators 18 rotate cams 16 and cam gripping surfaces 16' out of engagement with retrieval line 32 allowing retrieval line 32 to apply force to upper sail patch 62 and complete dousing spinnaker 60 similar to the embodiment of FIG. 1 as illustrated in FIGS. 16A-D. Lines 65 attached to the remote releasable line lock devices 10 to the lower sail patch 64 and mid-sail patch 66 (see FIG. 4) can be arranged to allow the remote releasable line lock devices 10 to enter remote release device 90 while the spinnaker 60 gathers in front of remote release device 90 as described above with respect to FIG. 4.

As noted above, a winch 40 can be positioned in companionway 58 between cockpit 59 and the space under deck 54. Winch 40 can be mounted on a frame 42 that can be held in opposed slots 46 in the sidewalls 44 of companionway 58. Winch 40 can include a wheel 48 that can have a friction surface 49 on the face of wheel 48 that can be arranged to "grab" retrieval line 32 or spinnaker halyard line 69. Offset crank handles 43 can be operatively connected to wheel 48 to allow the operator to easily crank the winch 40 to douse or raise a sail such as spinnaker 60. Retrieval line 32 or spinnaker halyard line 69 can engage a portion of wheel 48 and friction surface 49 in operation. In operation the person sailing sailboat 50 places the appropriate line (i.e. retrieval line 32 or spinnaker halyard line 69) on wheel 48 and begins cranking the crank handles 43 to douse spinnaker 60 or hoist spinnaker 60 depending on which line is selected. Using the apparatus for dousing a sail a person can douse a sail, such as spinnaker 60, without assistance of other persons to make sure the sail does not fall into the water or become tangled in the sailboat rigging as the halyard and control lines for the sail are released.

Figure 7:
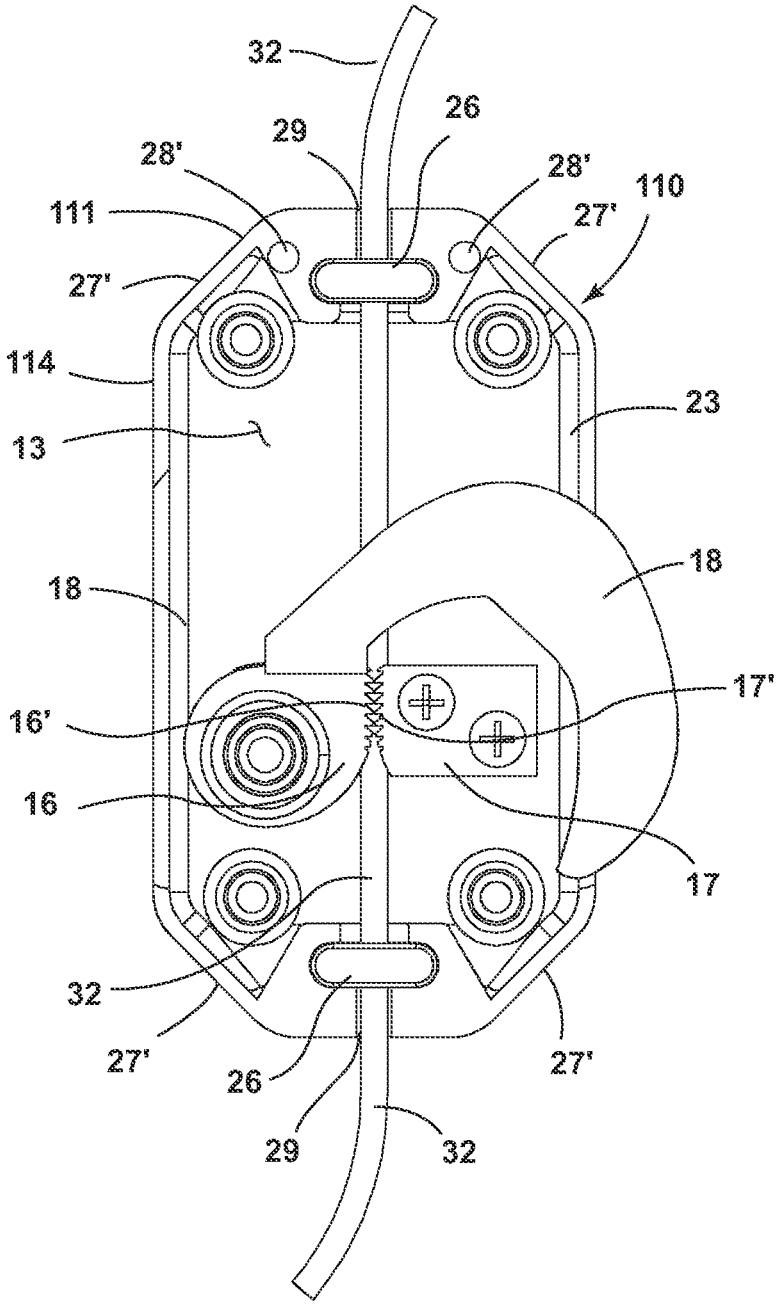
FIG. 7 is a view of another embodiment of a remote releasable line lock device with the cover removed.

FIGS. 7-12 and 14 illustrate alternate embodiments of a remote releasable line lock device. Common elements of the remote releasable line locks are referred to with the same numerals in FIGS. 7-12 and 14 for convenience. A noted above the remote releasable line lock device housings can be made of plastic or metal material. Turning to FIG. 7 a remote releasable line lock device 110 can be seen that can comprise one rotatable cam 16 that can have a cam actuator 18 and cam gripping surface 16' in a housing 111 that can be similar to the embodiment illustrated in FIGS. 3-5. Similarly, the cams and cam actuators can be made of metal or plastic material. Remote releasable line lock device 110 can have a fixed cam 17 with a cam gripping surface 17' arranged opposite rotatable cam 16 so that when cam 16 is in the position illustrated in FIG. 7 retrieval line 32 can be locked between rotatable cam 16 and fixed cam 17 when force is applied in a downward direction to release line 32. While fixed cam 17 is illustrated as being mounted on base 14, those skilled in the art will understand that fixed cam 17 and gripping surface 17' can be integral with base 14. Remote releasable line lock device 110 can operate in the same manner as remote releasable line lock device 10 as described above in that when remote releasable line lock device 110 enters into a remote release device 30 as described above cam actuator 18 can engage the cylindrical portion 36 rotating cam 16 and cam gripping surface 16' out of engagement with retrieval line 32 allowing retrieval line 32 to pass through remote releasable line lock device 110. Remote releasable line lock device 110 can have a base 114 and a cover 112, not shown, that can be similar to the embodiment in FIGS. 3-5. Remote releasable line lock device 110, other than the provision of a fixed cam 17 in housing 111 instead of a rotatable cam 16, can be similar to, assembled and used in a similar manner as remote releasable line lock device 10 described above in detail.

Figure 8:
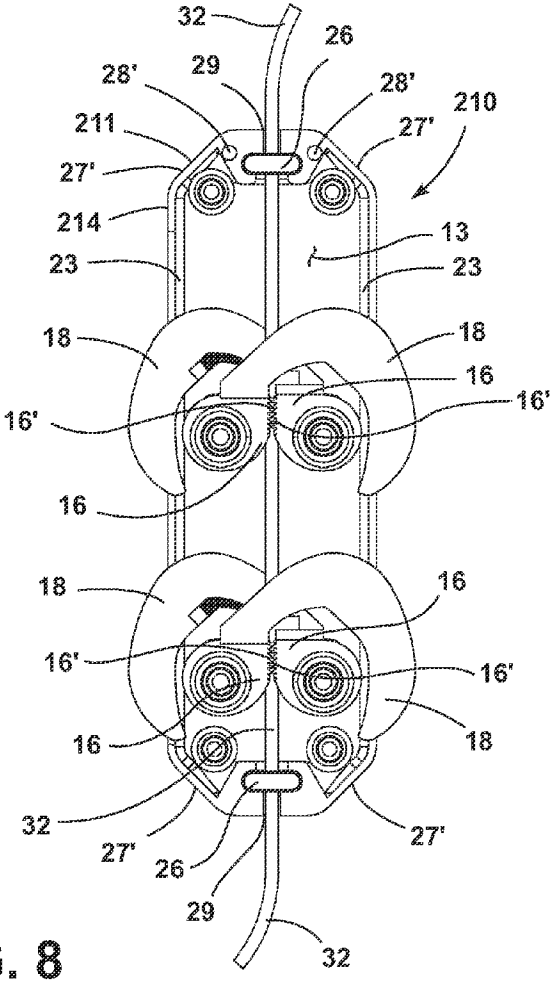
FIG. 8 is a view of another embodiment of a remote releasable line lock device with the cover removed.
Figure 14:
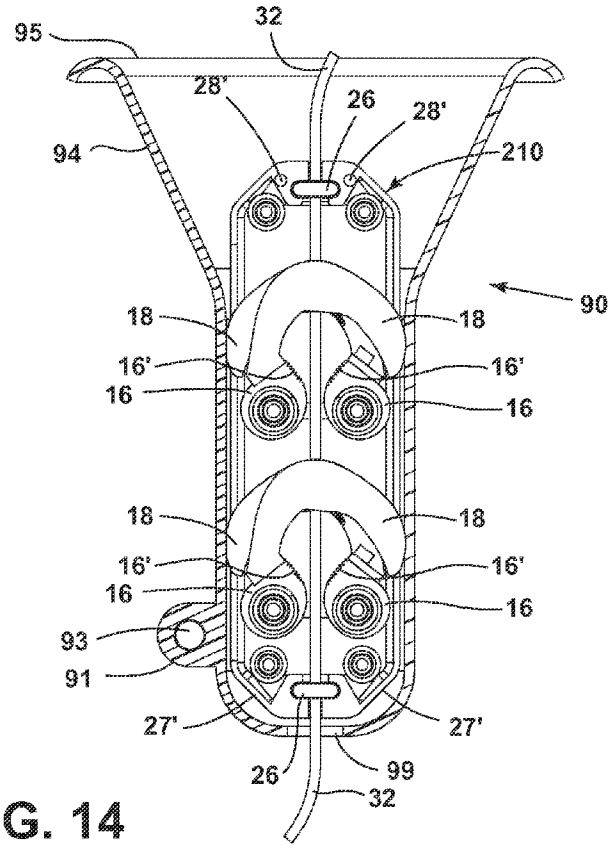
FIG. 14 is a sectional view showing the remote releasable line lock device of FIG. 8 positioned in a remote release device.

Turning to FIGS. 8 and 14 another embodiment of a remote releasable line lock device 210 can be seen positioned in remote release device 90. Common elements of the remote releasable line lock device embodiments are referred to with the same numerals in FIGS. 8 and 14 for convenience. A noted above the remote releasable line lock device housings can be made of plastic or metal material. Remote releasable line lock device 210 can be similar to remote release line lock device 10 but provided with two sets of cams 16 having cam actuators 18 and cam gripping surfaces 16' in housing 211. Remote releasable line lock device 210 can have increased gripping power on release line 32 with two sets of cams 16 and cam gripping surfaces 16'. Remote releasable line lock device 210 can have a base 214 and a cover 212, not shown, that can be similar to the embodiment in FIGS. 3-5. Other than the increased size of housing 211, remote releasable line lock device 210 can be similar to, assembled and used in a similar manner as remote releasable link lock device 10 as described above.

Figure 9:
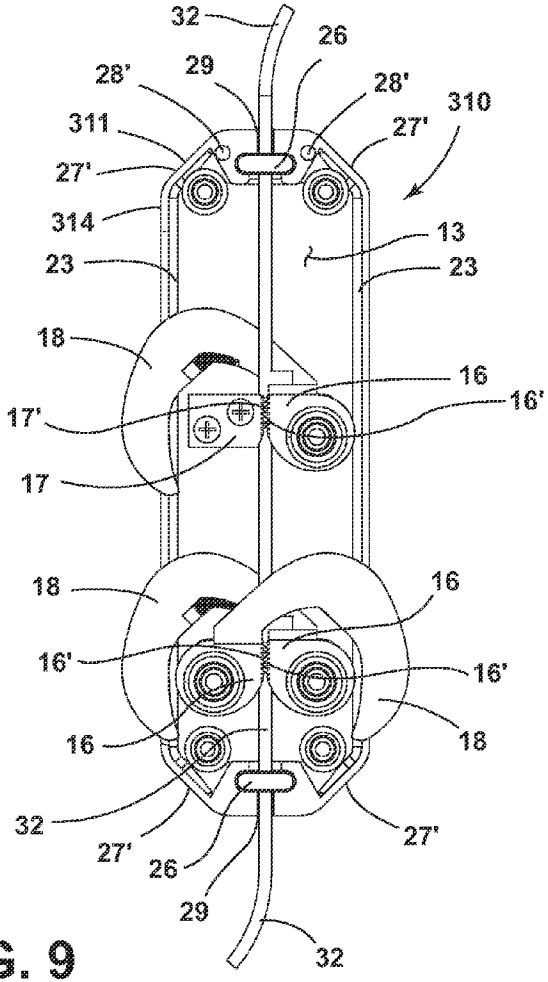
FIG. 9 is a view of another embodiment of a remote releasable line lock device with the cover removed.

Turning to FIG. 9 another embodiment of a remote releasable line lock device 310 can be seen. Common elements of the remote releasable line lock device embodiments are referred to with the same numerals in FIG. 9 for convenience. A noted above the remote releasable line lock device housings can be made of plastic or metal material. Remote releasable line lock device 310 can be similar to remote release line lock device 10 but provided with one set of cams 16 having cam actuators 18 and cam gripping surfaces 16' and a single cam 16, cam gripping surface 16' and cam actuator 18 opposite fixed cam 17 in housing 311 similar to the remote releasable line lock 110 embodiment illustrated in FIG. 7. Remote releasable line lock device 310 can have increased gripping power on release line 32 with one set of cams 16 and cam gripping surfaces 16' and a cam 16 and gripping surface 16' arranged to engage line 32 with fixed cam 17. Remote releasable line lock device 310 can have a base 314 and a cover 312, not shown, that can be similar to the embodiment in FIGS. 3-5. Other than the increased size of housing 311 and fixed cam 17, remote releasable line lock device 310 can be similar to, assembled and used in a similar manner as remote releasable line lock device 10 and 110 as described above.

Figure 11:
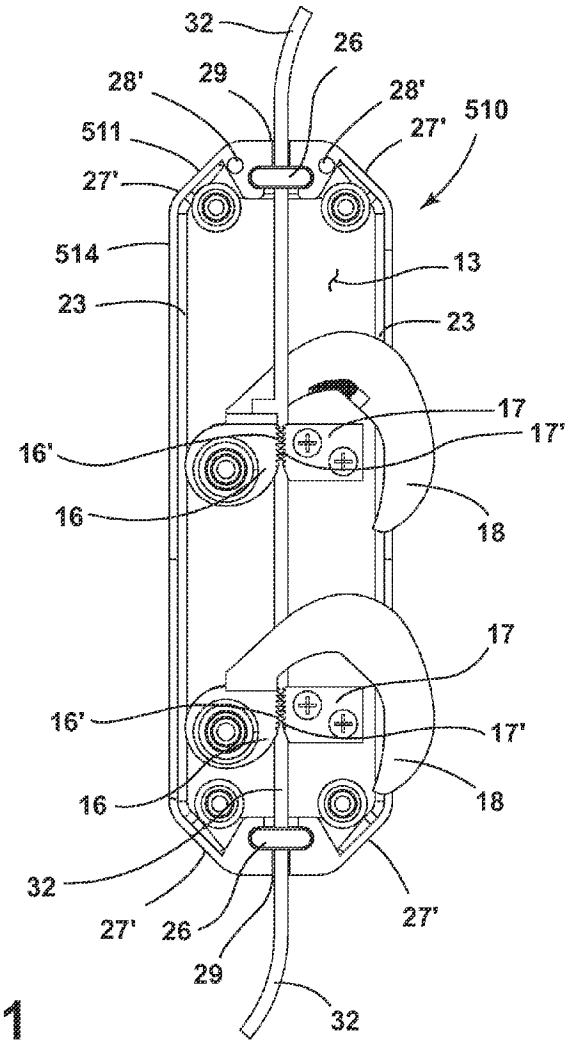
FIG. 11 is a view of another embodiment of a remote releasable line lock device with the cover removed.
Figure 10:
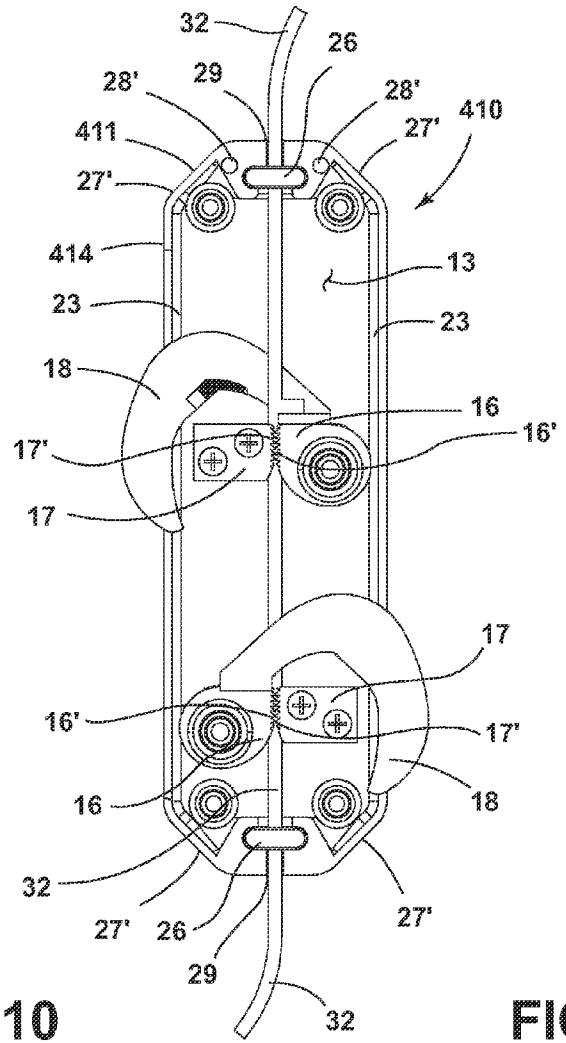
FIG. 10 is a view of another embodiment of a remote releasable line lock device with the cover removed.

Turning to FIGS. 10 and 11 other embodiments of a remote releasable line lock device 410 and 510 can be seen. Common elements of the remote releasable line lock device embodiments are referred to with the same numerals in FIGS. 10 and 11 for convenience. A noted above the remote releasable line lock device housings can be made of plastic or metal material. Remote releasable line lock devices 410 and 510 can be similar to remote release line lock device 110 but provided with two sets of a rotatable cam 16, cam actuator 18 and cam gripping surface 16' paired with a fixed cam 17 similar to the remote releasable line lock device 110 illustrated in FIG. 7. In the embodiment of FIG. 10 rotatable cams 16 can be positioned on opposite sides of housing 411 and in the embodiment of FIG. 11 rotatable cams 16 can be positioned on the same side of housing 511. Those skilled in the art will understand that the position of rotatable cams 16 and fixed cams 17 in each of the embodiments of FIGS. 10 and 11 can be reversed. Remote releasable line lock devices 410 and 510 can have bases 414 and 514 and covers 412 and 512, not shown, that can be similar to the embodiment in FIGS. 3-5. Other than the increased size of housings 411 and 511 remote releasable line lock devices 410 and 510 can be similar to, assembled and used in a similar manner as remote releasable link lock device 110 as described above.

Figure 12:
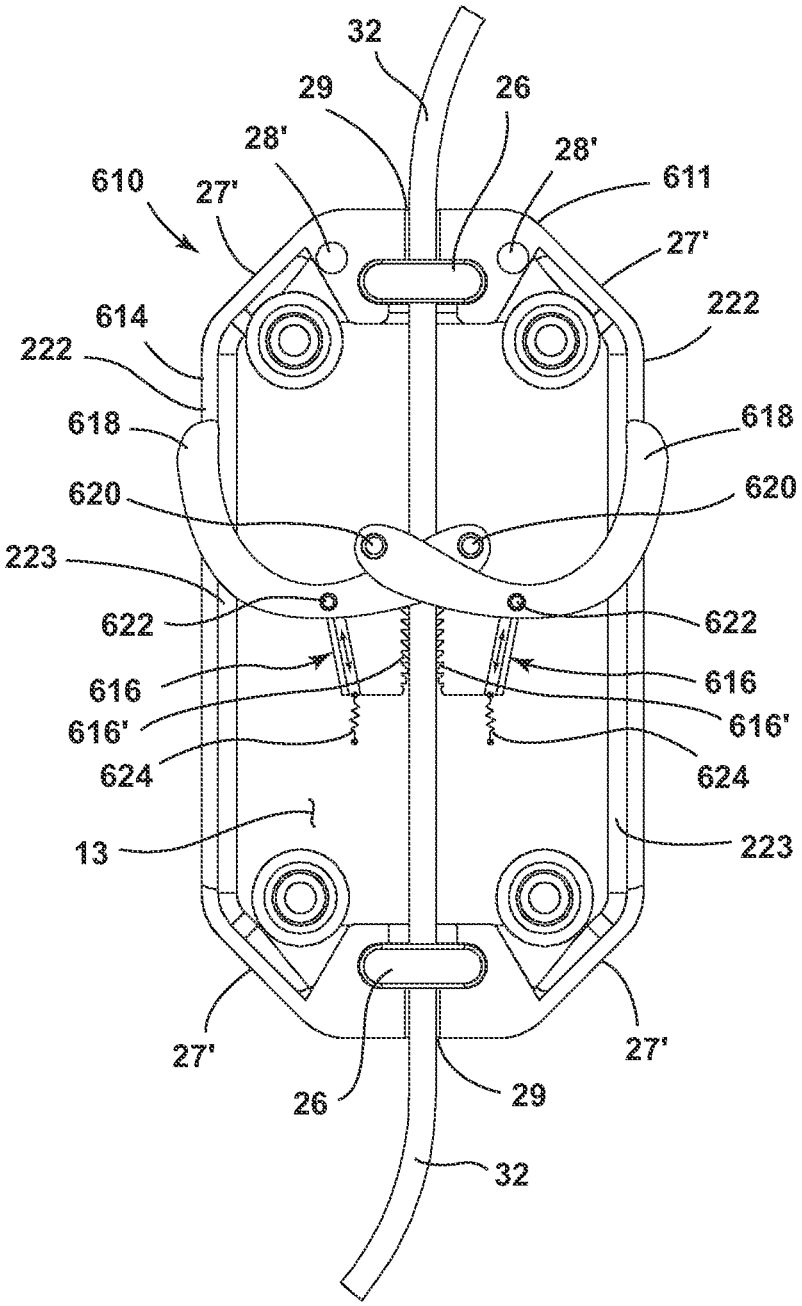
FIG. 12 is a view of another embodiment of a remote releasable line lock device with the cover removed.

Turning to FIG. 12 another embodiment of remote releasable line lock device 610 having slidable cams 616 having cam gripping surfaces 616' and cam actuators 618 can be seen. As noted above the cams and cam actuators can be made of metal or plastic material. Remote releasable line lock device 610 can have a housing 611 that can be generally shaped and constructed similar to housing 11 and can have an cover 612, not shown, and a base 614 that can be similar to cover 12 and base 14 in the embodiment of FIGS. 3-5. Similarly the remote releasable line lock device housings can be made of plastic or metal material. Housing 611 can have a central passage for retrieval line 32 including line guards 26 similar to housing 11. Cam actuators 618 can be pivotally mounted in base 614 by pivot pins 620 that can allow cam actuators 618 extend beyond the side walls 222, 222' of housing 611 through openings or slots 223 to be engaged and rotated by the cylindrical portion 36 of a remote release device 30. Cam actuators 618 can be linked to respective slidable cams 616 by a link pin 622. Slidable cams 616 can each be biased downwardly (as seen in FIG. 12) by a spring 624 to cause cam gripping surfaces 616' to engage retrieval line 32. When force is applied to retrieval line 32 to douse spinnaker 60 the downward force on retrieval line 32 can cause slidable cams 616 to grip retrieval line 32. When remote releasable line lock device 610 enters a remote release device 30, and cam actuators 618 engage the cylindrical portion of remote release device 30 cam actuators 618 are rotated into housing 611 lifting slidable cams 616 upwardly releasing retrieval line 32. Similar to remote releasable line lock device 10, when retrieval line 32 is pulled in the upward direction, cams 616 can slide upwardly against the tension of springs 624 allowing cam gripping surfaces 616' to part allowing retrieval line 32 to move upwardly through remote releasable line lock 610. Remote releasable line lock device 610 can otherwise be assembled and used similarly to remote releasable line lock device 10 as described in detail above.

Remote release devices 30 and 90 are illustrated herein as being generally cylindrical and conical in shape. However, remote release devices need only surfaces that can engage cam actuators such as cam actuators 18 and 618. For example, if the surfaces of the remote release devices 30 and 90 are rectangular in cross section instead of cylindrical and conical the funnel portions 34 and 94 could be arranged to orientate the remote releasable line lock device 10, 110, 210, 310, 410, 510 or 610 prior to entering the portion arranged to engage the cam actuator elements. Those skilled in the art will appreciate that shapes other than cylindrical and rectangular can be employed for a remote release device so long as an entry portion allowing a remote releasable line lock device to enter and a portion arranged to engage and depress cam releases into the remote releasable line lock device are provided.

I claim:

1. A remote releasable line lock device for use with a line comprising:

a housing having a base and a cover, and having at least one attachment point to secure the housing to an object;

opposed line openings in the housing for the line, the line passing longitudinally through the housing and the line openings;

first and second cams on the base on opposite sides of the line, at least the first cam being movably mounted on the base and biased toward the second cam and having a gripping surface opposite the second cam, the first cam and the second cam being positioned on the base to grip the line when force is applied to the line in a first direction relative to the housing, and to allow the line to pass through the first cam and second cam when force is applied to the line in a second opposite direction relative to the housing;

the first cam having a cam actuator extending outwardly from the housing through a first cam actuator opening in the housing, the cam actuator being operable to move the first cam gripping surface away from the second cam to release the line.

2. The remote releasable line lock device according to claim 1, wherein the second cam is movably mounted on the base and biased toward the first cam and further includes a gripping surface opposite the first cam and a cam actuator, the cam actuator for the second cam extending outwardly from the housing through a second cam actuator opening in the housing spaced from the first cam actuator opening, the cam actuators of the first and second cams being operable to move the gripping surfaces of the first and second cams apart to release the line.

3. The remote releasable line lock device according to claim 2, wherein the first cam and the second cam are pivotally mounted on the base.

4. The remote releasable line lock device according to claim 2, wherein the first cam and the second cam are slideably mounted on the base.

5. The remote releasable line lock device according to claim 1, the second cam being integral with the base and including a gripping surface opposite the first cam.

6. The remote releasable line lock device according to claim 1, wherein the base and cover form a generally enclosed space including spaced opposed side walls and spaced opposed end walls, the opposed line openings being respectively positioned in the opposed end walls; and the housing further includes a spring arranged to bias the first cam toward the second cam.

7. The remote releasable line lock device according to claim 1, wherein the opposed end walls further include portions tapered from the line opening to the respective opposed side walls.

8. The remote releasable line lock device according to claim 1, wherein the base further comprises at least one cam boss, the first cam being pivotally mounted on the at least one cam boss.

9. The remote releasable line lock device according to claim 8, further including a bearing pivotally supporting the first cam on the at least one cam boss.

10. The remote releasable line lock device according to claim 9, wherein the base further includes a spring post, the first cam further comprises a cam post and wherein the spring is connected to the spring post and the cam post, the spring biasing the first cam toward the second cam and cam actuator outwardly through the first cam actuator opening.

11. The remote releasable line lock device according to claim 1, wherein the housing further includes first and second line guards supported by the housing adjacent respective line openings, the line guards each having a line guard opening aligned with a respective housing line opening, the line passing through the line guard openings and the housing line openings.

12. The remote releasable line lock device according to claim 1, further comprising:

third and fourth cams on the base spaced from the first and second cams, at least the third cam being movably mounted on the base and biased toward the fourth cam and having a gripping surface opposite the fourth cam, the third cam and the fourth cam being positioned on the base to grip the line when force is applied to the line in a first direction relative to the housing, and to allow the line to pass through the third cam and the fourth cam when force is applied to the line in a second direction relative to the housing;

at least the third cam having a cam actuator extending outwardly from the housing through a cam actuator opening in the housing, the third cam actuator being operable to move the third cam gripping surface away from the fourth cam to release the line.

13. The remote releasable line lock device according to claim 12, the second and fourth cams each being movably mounted on the base and biased toward the first and third cams respectively and further including a gripping surface opposite the first and third cams respectively and a cam actuator, the cam actuators of the second and fourth cams extending outwardly from the housing through cam actuator openings spaced from the cam actuator openings for the first and third cam actuators, the cam actuators of the first and second cams and the third and fourth cams being operable to move the gripping surfaces of the first and second cams and the third and fourth cams apart to release the line.

14. The remote releasable line lock device according to claim 12, at least one of the second and fourth cams being fixedly mounted on the base.

15. The remote releasable line lock device according to claim 12, the second and fourth cams being fixedly mounted on the base.

16. The remote releasable line lock device according to claim 15, wherein the second and fourth cams are positioned on opposite sides of the line on the base.

17. The remote releasable line lock device according to claim 15, wherein the second and fourth cams are positioned on the same side of the line on the base.

18. Apparatus for remotely releasing a line comprising:

a line;

an object;

a remote releasable line lock device arranged to be connected to the object comprising:

a housing having a base and a cover, the housing having a width and having at least one attachment point to secure the housing to the object;

opposed line openings in the housing for the line, the line passing longitudinally through the housing and the line openings;

first and second cams on the base on opposite sides of the line, at least the first cam being movably mounted on the base and biased toward the second cam and having a gripping surface opposite the second cam, the first cam and the second cam being positioned on the base to grip the line when force is applied to the line in a first direction relative to the housing, and to allow the line to pass through the first cam and the second cam when force is applied to the line in a second opposite direction relative to the housing;

the first cam having a cam actuator extending outwardly from the housing through a first cam actuator opening in the housing, the cam actuator being operable to move the first cam gripping surface away from the second cam to release the line; and a remote release device comprising:

a first funnel shaped portion having an open mouth with a diameter larger than the width of the housing with the cam actuator extending outwardly from the housing;

a second portion connected to the funnel portion sized to engage and operate the cam actuator when the housing is positioned in the second portion to release the line and thereby allowing line to move independently of the remote releasable line lock device and the object when the housing is positioned in the second portion; and a remote release device opening in the second portion opposite the funnel portion and positioned for the line to pass through the first funnel portion and the second portion.

19. A spinnaker raising and dousing system for a sailboat having a mast that extends uprightly from the sailboat comprising:

a spinnaker sail having a head and two lower corners that is disposed generally fore of the mast when deployed, the sail having;

a halyard attached to the head of the sail arranged for hoisting and securing the spinnaker in the raised position on the mast;

at least two sheets attached to respective lower corners arranged for controlling the sail;

a first anchor attached to an upper portion of the sail;

a second anchor attached to a lower portion of the sail;

a retrieval line connected to the first anchor; and a remote releasable line lock device attached to the second anchor comprising;

a housing having a base and a cover, the housing having a width;

opposed retrieval line openings in the housing for the retrieval line, the retrieval line passing longitudinally through the housing and the retrieval line openings;

first and second cams on the base on opposite sides of the retrieval line, at least the first cam being movably mounted on the base and biased toward the second cam and having a gripping surface opposite the second cam, the first cam and second cam being positioned on the base to grip the retrieval line when force is applied to the retrieval line in a first direction relative to the housing, and to allow the retrieval line to pass through the first cam and second cam when force is applied to the line in a second opposite direction relative to the housing; whereby the remote releasable line lock device moves with the retrieval line when force is applied to the retrieval line in the first direction, and allows the retrieval line to pass through the first and second cams when force is applied to the retrieval line in a second opposite direction relative to the housing;

at least the first cam further having a cam actuator extending outwardly from the housing through a cam actuator opening in the housing, the cam actuator being operable to move the first cam gripping surface out of engagement with retrieval line to release the retrieval line; and a remote release device attached to the sailboat comprising:

a first funnel portion having a mouth with a diameter larger than the width of the housing with the at least one cam actuator extending outwardly from the housing;

a second portion connected to the funnel portion sized to engage and operate the at least one cam actuator when the housing is positioned in the second portion and thereby release the retrieval line; and a remote release device opening in the second portion opposite the funnel portion positioned for the retrieval line to pass through the first funnel portion and the second funnel portion; and a spinnaker control device; the retrieval line extending from the first anchor, through the remote release line lock device, through the spinnaker control device and through the remote release device and the remote release device opening.

20. A method of dousing the spinnaker sail on the sailboat according to claim 19 comprising:

releasing the halyard;

releasing the at least two sheets;

applying force in the first direction to the retrieval line to draw the spinnaker down toward and through the spinnaker control device by applying force through the remote releasable line lock device to the second anchor;

continuing to apply force to the retrieval line in the first direction until the remote releasable line lock device enters the remote release device thereby releasing the retrieval line in the remote releasable line lock device; and continuing to apply force to the retrieval line in the first direction to draw the spinnaker down and through the spinnaker control device by applying downward force to the first anchor.

* * * * *